US006508223B2

(12) United States Patent
Laimböck et al.

(10) Patent No.: US 6,508,223 B2
(45) Date of Patent: Jan. 21, 2003

(54) FOUR CYCLE OUTBOARD INTERNAL COMBUSTION ENGINE FOR DRIVING A WATERCRAFT

(75) Inventors: Franz Laimböck, Thal (AT); Christopher N. Cowland, Ann Arbor, MI (US); Robert J. Moran, Ann Arbor, MI (US)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 09/933,673

(22) Filed: Aug. 22, 2001

(65) Prior Publication Data

US 2002/0023599 A1 Feb. 28, 2002

(30) Foreign Application Priority Data

Aug. 24, 2000 (AT) ..... 620/2000 U

(51) Int. Cl.[7] ..... F02F 7/00

(52) U.S. Cl. ..... 123/195 P; 123/195 HC; 123/53.2

(58) Field of Search ..... 123/59.6, 195 P, 123/195 HC, 53.2

(56) References Cited

U.S. PATENT DOCUMENTS 5,704,819 A 1/1998 Isogawa 5,873,332 A * 2/1999 Taue et al. ..... 123/52.4

FOREIGN PATENT DOCUMENTS

| | | |
|---|---|---|
| DE | 2602701 | 7/1977 |
| DE | 2708556 | 9/1977 |
| DE | 3322447 | 1/1984 |
| EP | 0654590 | 5/1995 |
| FR | 8311279 | 1/1984 |
| JP | 60161296 | 8/1985 |

* cited by examiner

*Primary Examiner*—Noah P. Kamen
(74) *Attorney, Agent, or Firm*—Dykema Gossett PLLC

(57) ABSTRACT

A four cycle outboard internal combustion engine for driving a watercraft with a cylinder housing having cylinders arranged in at least two rows, wherein a piston is reciprocating in each cylinder, the pistons driving an approximately horizontally accommodated propeller drive shaft by way of an approximately vertically arranged crankshaft, each cylinder bank being provided with cylinder head sealing surfaces for a cylinder head housing receiving gas shuttle valves and wherein the cylinder head sealing surfaces of all of the cylinders are arranged in one single cylinder head sealing plane and an exhaust main manifold for all of the cylinders is arranged approximately parallel to the crank shaft in the cylinder head housing in the area of a central plane of the motor which is configured parallel to the crankshaft. One crankshaft is provided for each cylinder bank, the crankshafts having a stable relative speed ratio and acting upon the propeller drive shaft through a common jackshaft.

15 Claims, 5 Drawing Sheets

FOUR CYCLE OUTBOARD INTERNAL COMBUSTION ENGINE FOR DRIVING A WATERCRAFT

BACKGROUND OF THE INVENTION

The invention relates to a four cycle outboard internal combustion engine for driving a watercraft with a cylinder housing having cylinders arranged in at least two rows, wherein a piston is reciprocating in each cylinder, said pistons driving an approximately horizontally accommodated propeller drive shaft by way of an approximately vertically arranged crankshaft, each cylinder bank being provided with cylinder head sealing surfaces for a cylinder head housing receiving gas shuttle valves and wherein the cylinder head sealing surfaces of all of the cylinders are arranged in one single cylinder head sealing plane and an exhaust main manifold for all of the cylinders is arranged approximately parallel to the crankshaft in the cylinder head housing in the area of a central plane of the motor which is configured parallel to the crankshaft.

When used as outboard motors, the four cycle internal combustion engines have an advantage over two cycle internal combustion engines which is that a closed lubricant recirculating system may be used, waters and atmosphere being less polluted as a result thereof. On the other side however, it has the disadvantage that the torque of the piston displacement per cylinder is smaller than with the two-cycle internal combustion engine. This torque deficit may be compensated by increasing the number of revolutions and the speed increasing ratio as well as the capacity, the space available with an outboard motor being restricted though.

DESCRIPTION OF PRIOR ART

U.S. Pat. No. 5,704,819 discloses a four cycle internal combustion engine for an outboard motor with two cylinder banks arranged in V-shape. The cylinder head sealing planes are relatively inclined. For each cylinder bank one cylinder head housing is flange-mounted to a cylinder head sealing plane. The fact that each row of cylinders has separate cylinder head sealing planes and cylinder head housings entails the need for relative high expenditure in manufacture and assembly, though. The cylinder banks are inclined to one another at an angle of almost 60° so that the construction of the internal combustion engine is relatively wide.

EP 0 654 590 A2 discloses an outboard motor with two cylinder banks that are inclined to one another at a small angle, the cylinders acting upon one unique crankshaft. The cylinder head sealing surfaces of all of the cylinders are arranged in one single cylinder head sealing plane, very simple processing and simple mounting and dismounting of the cylinder head housing being made possible as a result thereof. As all of the cylinders have a uniform cylinder head sealing plane and are arranged in V-shape, the combustion chamber is wedge-shaped which causes asymmetrical load to be exerted on the piston.

The Japanese published application JP 60-161 296 A discloses an outboard motor which is provided with two paralleled motor units that are arranged abreast and whose crankshafts act upon a propeller drive shaft through a common jackshaft, the two crankshafts being provided with the same direction of rotation. The result thereof is a relatively high yawing moment. The fact that the two motor units are realized completely separately prejudices weight and size.

DE 33 22 447 A1 furthermore describes a two-cylinder four cycle internal combustion engine for vehicles with two crankshafts that are rotating in opposite directions. A camshaft for driving the gas shuttle valves of the cylinder head is arranged in the cylinder block between the cylinders, the valves being actuated through a tappet rod and through valve lifters. The camshaft, which is arranged in the cylinder block between the cylinders, bears adversely on the width of the internal combustion engine. Outboard motors of watercrafts require a slim design and that is why this conception cannot be readily adopted.

SUMMARY OF THE INVENTION

It is the object of the invention to avoid these drawbacks and to develop a four cycle internal combustion engine for an outboard motor with little expenditure in manufacture and assembly that is light-weighted and small in size and that allows to optimally design the combustion chamber.

The solution to this object in accordance with the invention is to provide one crankshaft for each cylinder bank, the crankshafts having a stable relative speed ratio and acting upon the propeller drive shaft through a common jackshaft. On account of the two crankshafts, there are no restrictions as to the constructional arrangement of the cylinders and to the design of the combustion chambers. A very slim and light design may still be realized.

In order to keep the yawing moment as low as possible it is advantageous to have the crankshafts rotating in different directions. Two cylinders that are positioned in relative neighbourhood relative to the central plane of the motor may thereby execute strokes in synchronism, which permit the realization of a very simple first-rank counterbalance. However, the torque transmitting components may thereby be subjected to larger amounts of strain. In order to avoid this, there may be provided that the cylinders, which are positioned in relative neighbourhood relative to the central plane of the motor, are each provided with an ignition that is offset by at least approximately 90°, preferably by 180°.

Another measure for achieving a very small width consists in having the exhaust valves of all of the cylinders controllable by one exhaust camshaft arranged preferably in the cylinder head housing, wherein the exhaust camshaft acts upon the exhaust valves of two cylinders that are positioned in relative neighbourhood relative to the central plane of the motor by way of a valve bridge preferably. Accordingly, three camshafts only are necessary, viz., two intake camshafts and one exhaust camshaft. This camshaft array permits to accommodate in the cylinder head housing at least one intake manifold per cylinder between the central exhaust camshaft and a lateral intake camshaft, which allows to configure a so-called reverse tumble in the combustion chamber. There is more specifically provided that two intake manifolds per cylinder discharge via one intake valve each into the combustion chamber and that at least one exhaust manifold leaves the combustion chamber via an exhaust valve, the intake valves and the exhaust valves being arranged on different sides of a high plane defined by a cylinder axis and an axis of the piston pin, the intake manifolds which are preferably intersecting the high plane being curved in such a manner that a reverse tumble is generated in the combustion chamber, said tumble being oriented from the intake valves toward the piston and from there to the exhaust valve. The exhaust manifold is guided downward relatively centrically relative to the shank of the outboard motor.

As an alternative to the embodiment with the three camshafts, there may be provided that per cylinder bank one camshaft provided with intake and exhaust cams is provided in the cylinder head housing, wherein two like gas shuttle valves per cylinder may preferably be actuated by one single cam by way of a fork rocker arm or a fork drag arm.

In order to keep the width as small as possible it is moreover advantageous to have the axes of all of the cylinders paralleled.

The fuel is preferably supplied by way of an indirect fuel injection device that discharges in at least one intake manifold per cylinder. Direct fuel injection into the combustion chamber is also conceivable though.

In a simple embodiment according to the invention, there is provided that the crankshafts are connected to each other by way of a first toothed gearing and that one of the two crankshafts is connected to the jackshaft by way of a second toothed gearing. The two crankshafts are connected to each other by way of gears that have the same number of teeth. Since the same teeth always mesh together, the tooth flanks may wear at an early stage. In order to avoid this, there is provided in another variant in accordance with the invention that one crankshaft is connected to the jackshaft by way of an encircling transmission and that the other crankshaft is connected to the jackshaft by way of a toothed gearing, the jackshaft preferably driving the camshafts arranged in the cylinder head housing by way of another encircling transmission.

Within the scope of the invention there may also be provided that an automatic transmission with at least two gears be arranged between the crankshaft and the propeller drive shaft.

In another embodiment there may furthermore be provided that the jackshaft is prolonged between the two rows of cylinders up to the front end of the engine opposite the propeller drive shaft. This permits easy drive of auxiliary units, e.g. of a generator and/or a flywheel, located at the front end of the engine opposite the propeller drive shaft by way of the jackshaft.

BRIEF DESCRIPTION OF THE DRAWINGS

The invention is explained in more detail hereinafter with reference to the drawings.

Like numerals reference to components with identical functions throughout the variants.

DETAILED DESCRIPTION OF THE PREFERRED EMBODIMENTS

Figure 2:
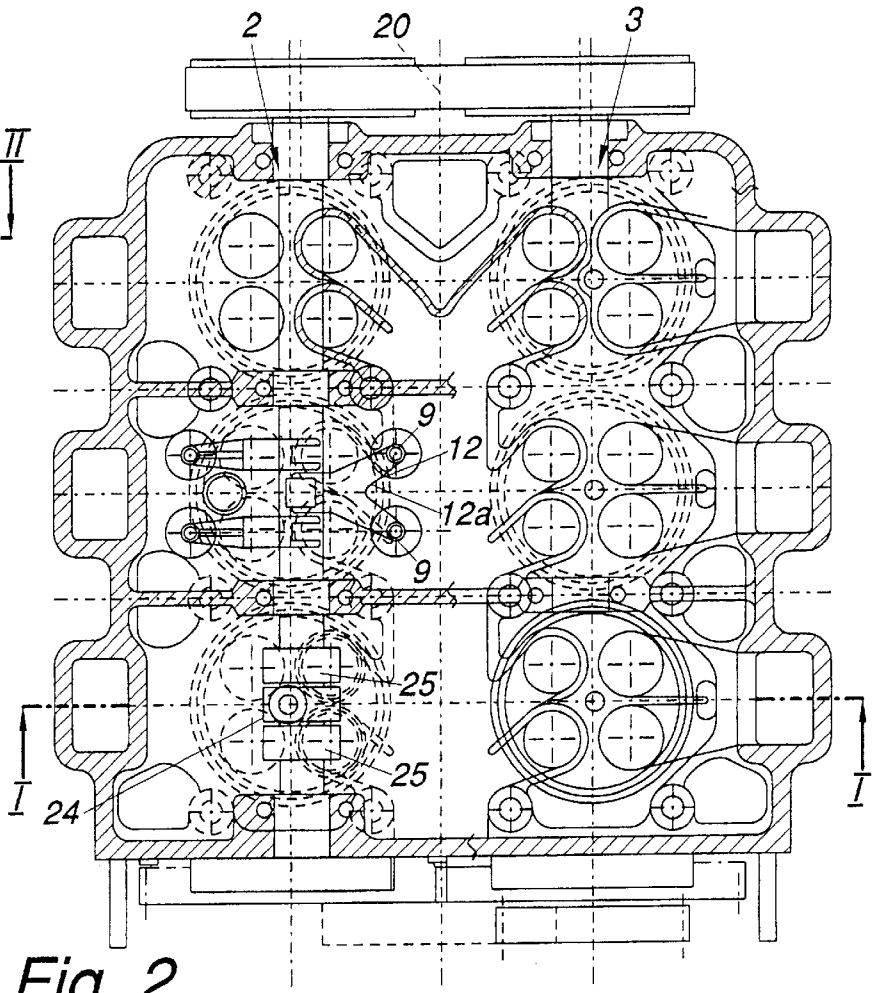
FIG. 2 is a schematic section of said internal combustion engine taken along the line II—II in FIG. 1.

In each variant, the internal combustion engine is provided with a cylinder housing 1 for two cylinder banks 2, 3, each cylinder bank 2, 3 consisting of at least two cylinders 4. In each cylinder 4 a piston 5 is reciprocating. The piston axis is indicated at 4*a*. In a cylinder head sealing plane 6 that is common to all of the cylinders 4, the cylinder housing 1 is provided with cylinder head sealing surfaces 6*b* which support a cylinder head housing 7 with a mating surface 6*a* that is common to all of the cylinders 4. The gas shuttle valves, which consist of intake valves 8 and of exhaust valves 9, and the valve actuating device 10 with one or several camshafts 11 and valve lifters 12, are accommodated in the cylinder head housing 7. Intake manifolds 13 and exhaust manifolds 14 are configured in the cylinder head housing 7. An indirect injection device 15 discharges in at least one intake manifold 13 per cylinder 4. The cylinder head housing 7 is closed by a cylinder head cover 16.

Thanks to the mating surface 6*a* of the cylinder head housing 7, which is the same for all of the cylinders 4 and which mates the cylinder head sealing plane 6 which is the same for the two cylinder banks 3 and 4, the expenditure in manufacture and assembly may be minimized.

Figure 1:
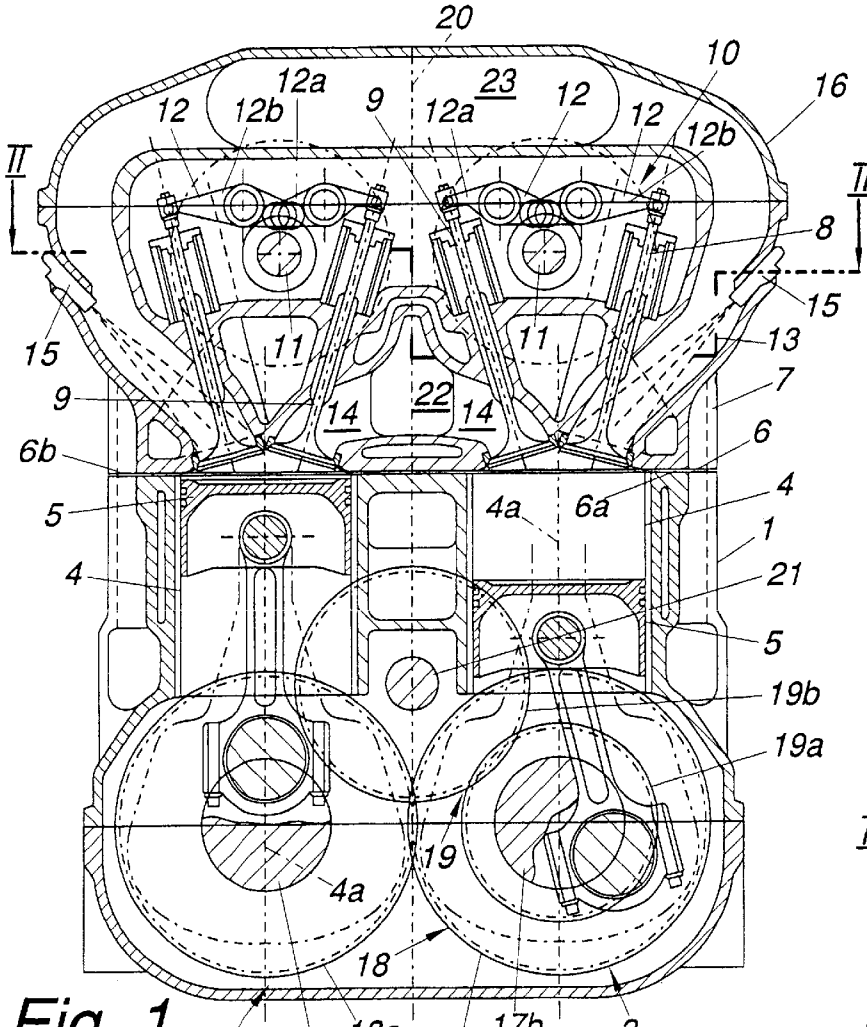
FIG. 1 is a schematic section of an internal combustion engine according to the invention in a first variant taken along the line I—I in FIG. 2.

In the first embodiment illustrated in the FIGS. 1 and 2, the axes 4*a* of the cylinders 4 are paralleled. The pistons 5 of the cylinder bank 2 act upon a first crankshaft 17*a*, the pistons 4 of the second cylinder bank 3 upon a second crankshaft 17*b*. The crankshafts 17*a*, 17*b* rotate in opposite directions and are connected to each other by way of a first toothed gearing 18 that consists of meshing cogwheels 18*a*, 18*b*. Thanks to the opposite direction of rotation of the crankshafts 17*a*, 17*b*, the yawing moment of the internal combustion engine may be kept the lowest possible. The second crankshaft 17*b* is connected to a jackshaft 21 arranged parallel to the crankshafts 17*a* and 17*b* in the region of a central plane of the motor 20 by way of a second toothed gearing 19 that consists of meshing cogwheels 19*a* and 19*b*. The jackshaft 21, which, in the outboard motor, is arranged almost vertically, acts upon an approximately horizontal propeller drive shaft (not shown). The central plane of the motor 20, which is located parallel to the crankshafts 17*a* and 17*b*, passes through the propeller drive shaft.

As may be surveyed from FIG. 1, the cylinder head housing 7 configures an main exhaust manifold 22 departing from the exhaust manifolds 14 in the region of the central plane of the motor 20, said main exhaust manifold being oriented approximately parallel to the jackshaft 21 or to the crankshaft 17, 17*a*, 17*b* in the region of the shank of the outboard motor that has not been illustrated in the drawings herein. The cylinder head cover 16 forms the main intake manifold 23. For each cylinder bank 2, 3. one camshaft 11 is arranged in the cylinder head housing 7. As can be surveyed from FIG. 2, the valve lifter 12 acting upon the exhaust valves 9 is configured as a fork rocker arm 12*a* that is actuated by an exhaust cam 24 and that acts upon the two exhaust valves 9 of a cylinder 4. A valve lifter 12 that is configured as a simple rocker arm 12*b* and that is actuated by an intake cam 25 acts upon each of the intake valves 8.

As best shown in FIG. 1, the firing points of two cylinders 4 that are facing each other about the central plane of the motor 20 are shifted by at least approximately 90°, the force exerted upon the jackshaft 21 being introduced therein within a greater angular range of the crank.

Figure 3:
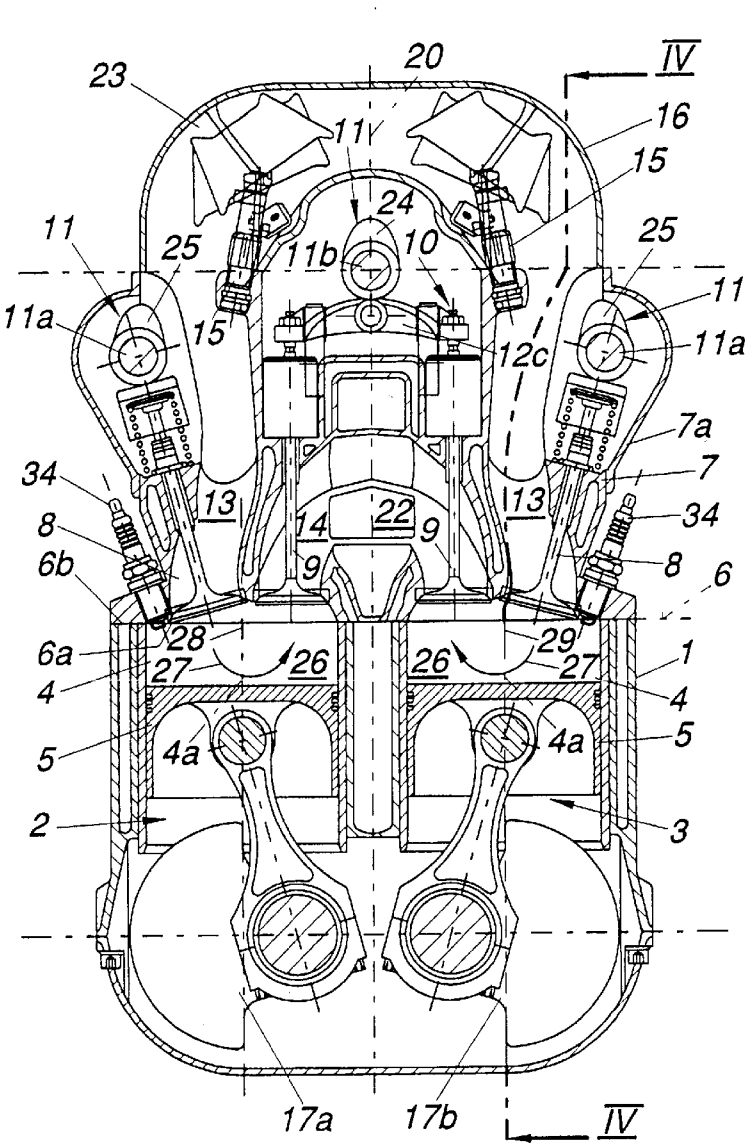
FIG. 3 is a schematic section of an internal combustion engine according to the invention in a second variant taken along the line III—III in FIG. 4.
Figure 4:
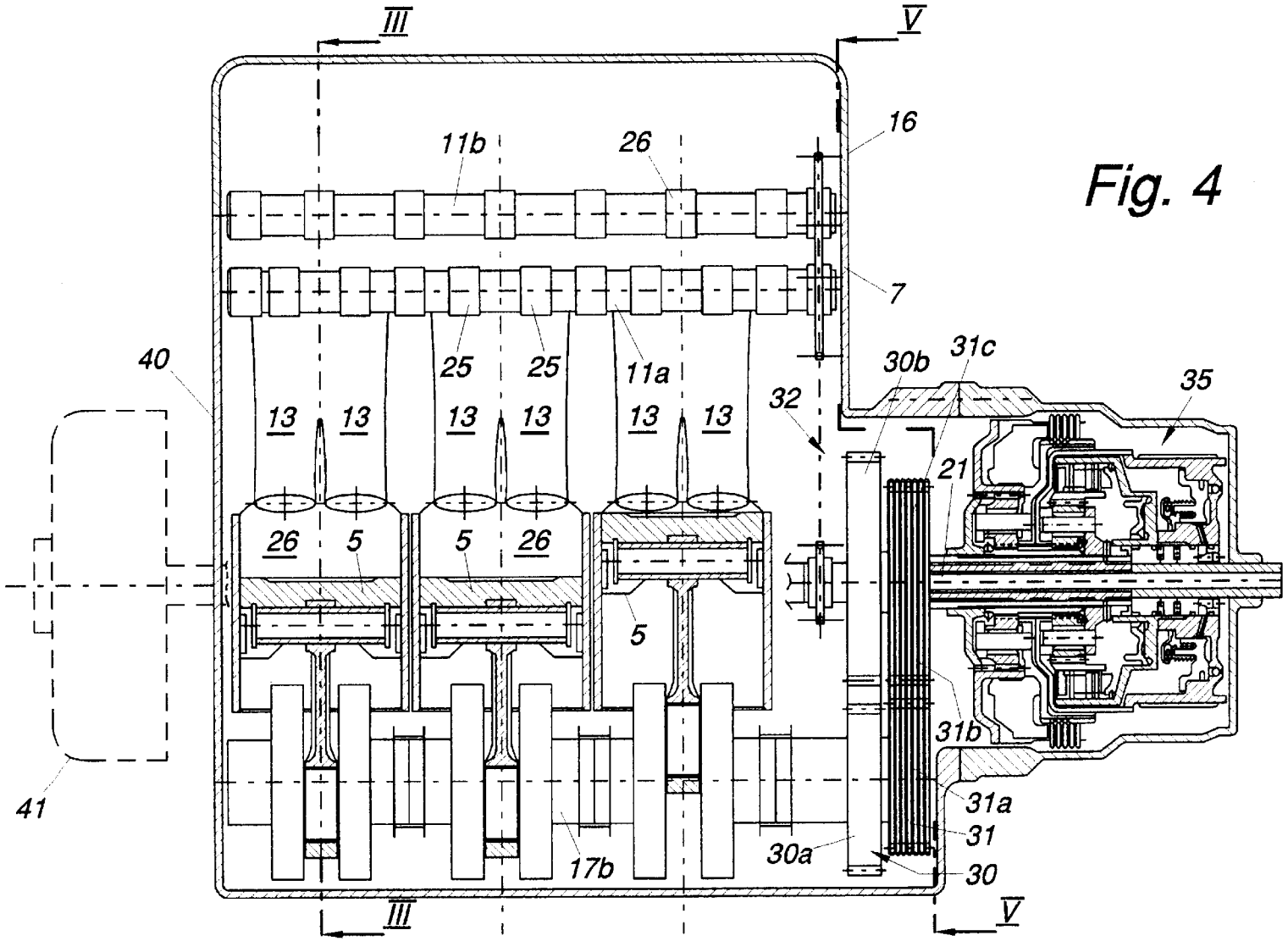
FIG. 4 is a schematic section of said internal combustion engine taken along the line IV—IV in FIG. 3.

The FIGS. 3 and 4 show a variant with three camshafts 11 accommodated in the cylinder head housing 7. The exhaust camshaft 11*b* is thereby accommodated in the region of the central plane of the motor 20 and the admission camshafts 11*a* of each cylinder bank 2, 3 are arranged near the side walls 7*a* in the cylinder head housing 7. There is accordingly enough space between the exhaust camshaft 11*b* and the intake camshafts 11*a* to guide an intake manifold 13 from the cylinder head cover 16 to the intake valves 8 in parallel orientation with regard to the axes 4*a* of the cylinders. A reverse tumble 27 may be induced in the combustion chamber 26 by the intake manifolds 8 as a result thereof, said tumble flowing from intake valves 8 to the piston 5 and from there to the exhaust valves 9. Both the intake valves 8 and the exhaust valves 9 are thereby accommodated on either side of a high plane 28, 29 formed by the axis 4*a* of the cylinder and by the axis of the piston pin 5*a*. Ignition plugs that are arranged laterally in the cylinder head housing 7 are indicated at 34. As indicated in FIG. 4 by dashed lines, the jackshaft 21 may be prolonged up to a front end of the engine 40 located opposite the propeller drive shaft by passing through the rows 2, 3 of cylinders 4, in order to drive a generator and/or a flywheel 41 or the like.

Figure 5:
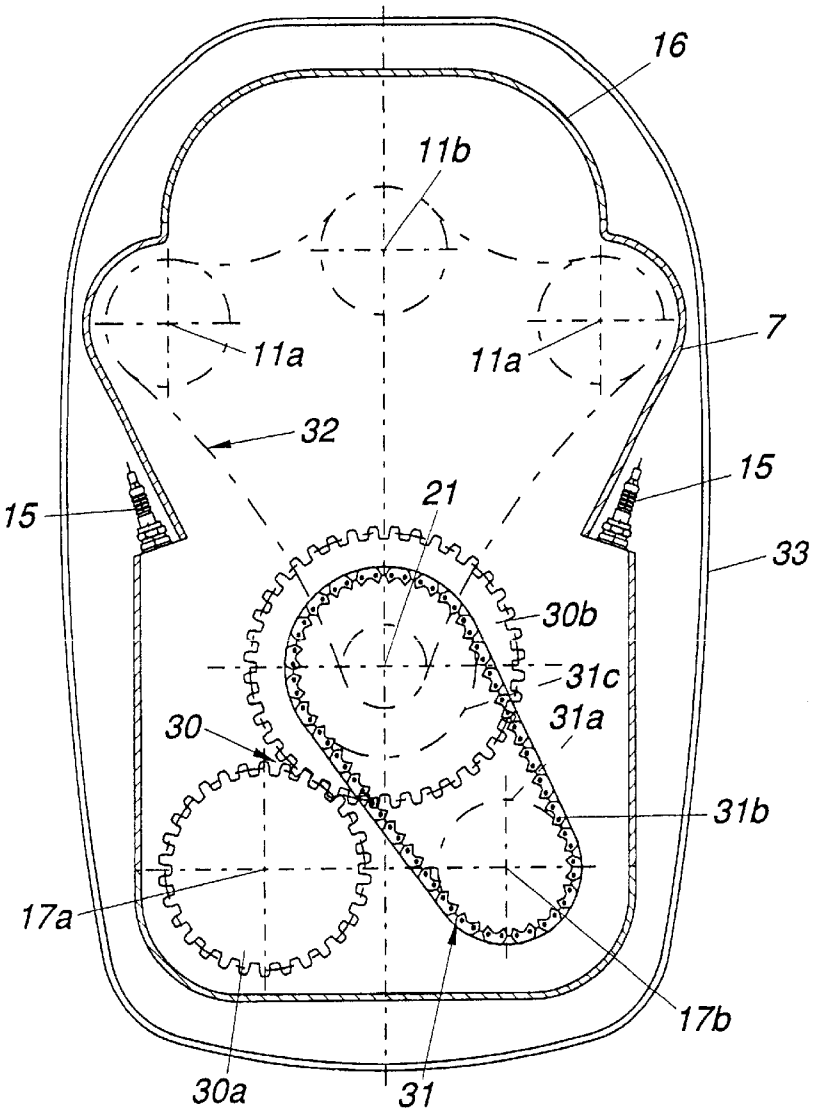
FIG. 5 is a schematic section of said internal combustion engine taken along the line V—V in FIG. 4.

Like in the already described embodiment, the pistons 5 of each cylinder bank 2, 3 act upon one respective crankshaft 17*a* and 17*b*, the two crankshafts 17*a* and 17*b* driving a jackshaft 21. Here though, the jackshaft 21 is not only driven by toothed gearings, but by a toothed gearing 30 between the first crankshaft 17*a* and the jackshaft 21 on one side and by an encircling transmission 31 between the second crankshaft 17*b* and the jackshaft 21 on the other, as can best be seen from FIG. 5. The toothed gearing 30 consists of the cogwheels 30*a* and 30*b* that mesh together. The encircling transmission 31 is provided with a drive gear 31*a*, with an encircling means 31*b* configured as a chain for example, and with a following gear 31*c*. An automatic transmission with at least two gears that is located between crankshaft 17, 17*a*, 17*b* or distributor shaft 21 respectively and the propeller drive shaft is indicated at numeral 35.

As can be surveyed from FIG. 3, two pistons 5 work in synchronism relative to the central plane 20 of the motor, i.e., they act in synchronism upon the jackshaft 21 by way of the first and second crankshaft 17*a* and 17*b*.

The exhaust camshaft 11*b* acts upon the exhaust valves 9 via a bridge 12*c*.

The intake camshaft 11*a* and the exhaust camshaft 11*b* are driven by the jackshaft 21 by way of another encircling transmission 32.

Both the gear ratio between the cogwheel 30*a* of the first crankshaft 17*a* and the cogwheel 30*b* of the jackshaft 21 and the gear ratio of the drive gear 31*a* of the second crankshaft 17*b* to the following gear 31*c* of the jackshaft 21 are 1:29 $\sqrt{2}$.

The cover of the outboard motor is indicated at numeral 33.

Figure 7:
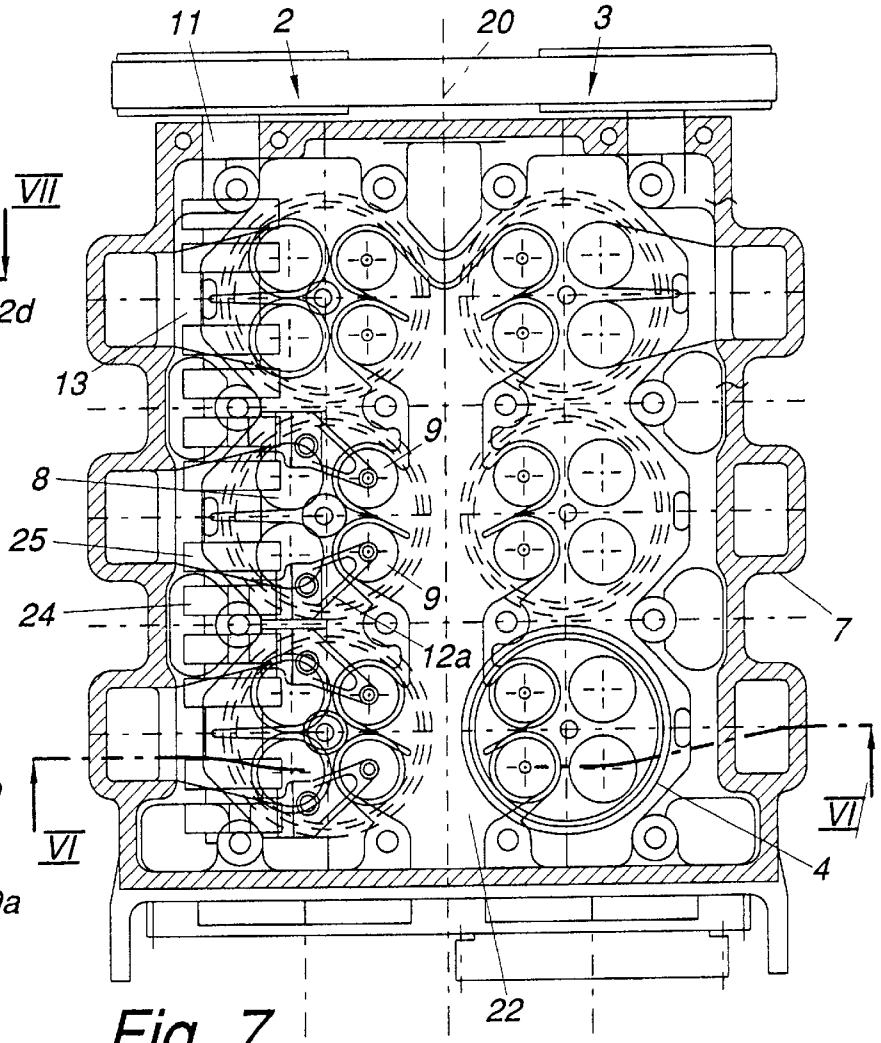
Figure 6:
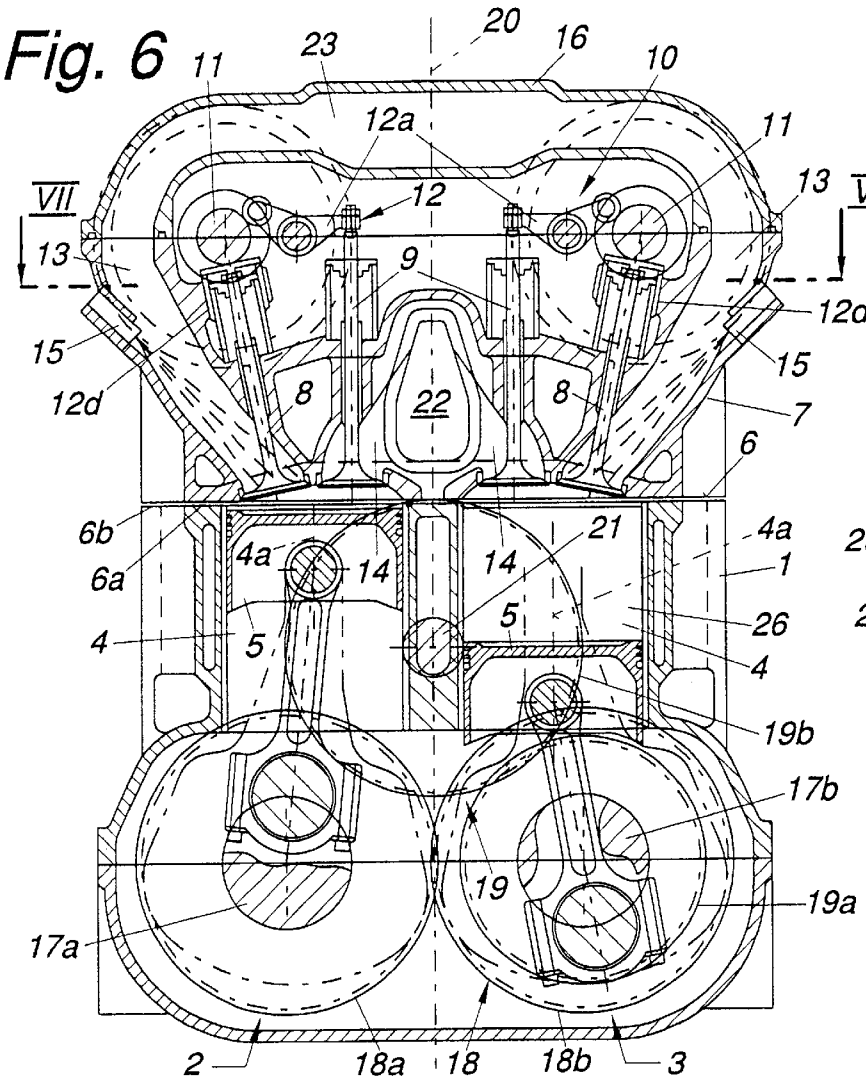
FIG. 6 is a schematic section of an internal combustion engine according to the invention in a third variant taken along the line VI—VI in FIG. 7 and, FIG. 7 is a schematic section of said internal combustion engine taken along the line VII—VII in FIG. 6.

The embodiment illustrated in the FIGS. 6 and 7 differs from the exemplary embodiment of the FIGS. 1 and 2 by the fact that the intake valves 8 are directly actuated by the camshaft 11 through the tappet 12*d* and that the exhaust valves 9 are actuated through valve lifter 12*a*. The exhaust valves 9 are arranged substantially parallel to the axis 4*a* of the cylinder. On account of the tappet actuated intake valves 8, the angle between the intake valves 8 and the exhaust valves 9 is much smaller than in the embodiment represented in the FIGS. 1 and 2, which permits to save constructional width.

What is claimed is:

1. A four cycle outboard internal combustion engine for driving a watercraft with a cylinder housing having cylinders arranged in at least two rows, wherein a piston is reciprocating in each cylinder, said pistons driving an approximately horizontally accommodated propeller drive shaft by way of an approximately vertically oriented crankshaft, each cylinder bank being provided with cylinder head sealing surfaces for a cylinder head housing receiving gas shuttle valves and wherein the cylinder head sealing surfaces of all of the cylinders are arranged in one single cylinder head sealing plane and an exhaust main manifold for all of the cylinders is arranged approximately parallel to the crankshaft in the cylinder head housing in the area of a central plane of the motor which is configured parallel to the crankshaft, including one crankshaft for each cylinder bank, the crankshafts having a stable relative speed ratio and acting upon the propeller drive shaft through a common jackshaft, and including means for causing said crankshafts to rotate in opposite directions.

2. The internal combustion engine according to claim 1, wherein the exhaust valves of all of the cylinders may be actuated by one exhaust camshaft arranged in the cylinder head housing, the exhaust camshaft acting upon the exhaust valves of two cylinders that are positioned in relative neighbourhood relative to the central plane of the motor by way of a valve bridge.

3. The internal combustion engine according to claim 1, wherein one camshaft provided with intake and exhaust cams is provided per cylinder bank in the cylinder head housing, two like gas shuttle valves per cylinder being controllable by one single cam by way of a fork rocker arm or a fork drag arm.

4. The internal combustion engine according to claim 1, wherein the pistons of two cylinders that are positioned in relative neighbourhood relative to the central plane of the motor execute strokes in synchronism.

5. The internal combustion engine according to claim 4, wherein the pistons of the respective two cylinders, which are positioned in relative neighbourhood relative to the central plane of the motor, execute lagging strokes, the phase difference amounting to at least 90°.

6. The internal combustion engine according to claim 4, wherein the pistons of the respective two cylinders, which are positioned in relative neighbourhood relative to the central plane of the motor, execute lagging strokes, the phase difference amounting to 180°.

7. The internal combustion engine according to claim 1, wherein said means for causing said crankshafts to rotate in opposite directions surprises a first toothed gearing, and wherein one of the two crankshafts is connected to the jackshaft by way of a second toothed gearing.

8. The internal combustion engine according to claim 1, wherein one crankshaft is connected to the jackshaft by way of an encircling transmission and that the other crankshaft is connected to the jackshaft by way of a toothed gearing.

9. An internal combustion engine according to claim 8, wherein the jackshaft is driving the camshaft(s) arranged in the cylinder head housing by way of another encircling transmission.

10. The internal combustion engine according to claim 1, wherein two intake manifolds per cylinder discharge via one intake valve each into the combustion chamber and that at least one exhaust manifold leaves the combustion chamber via an exhaust valve, the intake valves and the exhaust valves being arranged on different sides of a high plane defined by a cylinder axis and an axis of the piston pin, the intake manifolds, being curved in such a manner that a reverse tumble is generated in the combustion chamber, said tumble being oriented from the intake valves toward the piston and from there to the exhaust valve.

11. The internal combustion engine according to claim 1, wherein the axes of all of the cylinders are paralleled.

12. The internal combustion engine according to claim 1, wherein an automatic transmission with at least two gears is arranged between crankshaft and propeller drive shaft.

13. The internal combustion engine according to claim 1, wherein the jackshaft is prolonged between the two rows of cylinders up to the front end of the engine opposite the propeller drive shaft.

14. An internal combustion engine according to claim 13, wherein the jackshaft is connected to a flywheel at the front end of the motor opposite the propeller drive shaft.

15. An internal combustion engine according to claim 13, wherein the jackshaft is connected to a generator at the front end of the motor opposite the propeller drive shaft.

* * * * *